United States Patent [19]

Kolbe

[11] Patent Number: 4,544,260

[45] Date of Patent: Oct. 1, 1985

[54] REMOVABLE PROCESSING CARTRIDGE FOR ELECTROSTATOGRAPHIC REPRODUCING APPARATUS

[75] Inventor: James R. Kolbe, Sodus, N.Y.

[73] Assignee: Xerox Corporation, Stamford, Conn.

[21] Appl. No.: 614,203

[22] Filed: May 25, 1984

[51] Int. Cl.[4] ..... G03G 15/00

[52] U.S. Cl. ..... 355/3 BE; 355/3 R; 355/14 R; 355/16

[58] Field of Search ..... 355/3 R, 3 BE, 16, 3 DR, 355/14 R, 3 DD

[56] References Cited

U.S. PATENT DOCUMENTS

| | | | |
|---|---|---|---|
| B 500,171 | 3/1976 | Doi et al. | 355/3 R X |
| 3,637,306 | 1/1972 | Cooper | 355/15 |
| 3,647,293 | 3/1972 | Queener | 355/15 |
| 3,924,944 | 12/1975 | Smith et al. | 355/3 DD |
| 3,966,316 | 6/1976 | Pfeifer et al. | 355/3 R |
| 3,976,371 | 8/1976 | Moser et al. | 355/3 DD |
| 3,985,436 | 10/1976 | Tanaka et al. | 355/8 |
| 4,076,402 | 2/1978 | Kanno et al. | 355/3 DR |
| 4,087,170 | 5/1978 | Sawaoka et al. | 355/3 CH |
| 4,114,998 | 9/1978 | Shimizu et al. | 355/3 DR |
| 4,116,556 | 9/1978 | Tanaka et al. | 355/3 SH |
| 4,236,807 | 12/1980 | Kuehnle | 355/3 R |
| 4,264,199 | 4/1981 | Kuehnle | 355/66 |
| 4,271,786 | 6/1981 | Buckley et al. | 118/661 |
| 4,335,950 | 6/1982 | Gunzelmann et al. | 355/3 R |
| 4,372,669 | 2/1983 | Fantuzzo | 355/3 R |
| 4,386,841 | 6/1983 | Wakao et al. | 355/3 DR |
| 4,412,734 | 11/1983 | Shibuya et al. | 355/3 R X |
| 4,416,536 | 11/1983 | Itoh et al. | 355/14 R |

*Primary Examiner*—A. C. Prescott

[57] ABSTRACT

An electrostatographic reproducing apparatus using a removable processing cartridge containing at least one electrostatographic processing unit together with a cartridge mounting means to the main frame of the reproducing apparatus and cartridge positioning means is described. The cartridge positioning means comprises a pair of elastomeric loops adapted to engage a frame member of the reproducing apparatus with a compression spring action to thereby maintain the cartridge in its operational position. The loops are of sufficient size and shape that they may be used as handles to manually extract the cartridge from the reproducing apparatus. In the specific embodiment the elastomeric loops are fastened to the top of a cartridge at one end thereof which engages with a bottom of the upper frame portion of a clam-shell type machine when it is pivoted to the closed position thereby maintaining the cartridge in its operational position.

18 Claims, 11 Drawing Figures

80
80
49
50
37
42
46
59
60
40
61
54
45
53
12
83
43
82
45
87
66
56
64
38
65
57

REMOVABLE PROCESSING CARTRIDGE FOR ELECTROSTATOGRAPHIC REPRODUCING APPARATUS

REFERENCE TO COPENDING APPLICATIONS

Reference is hereby made to copending application Ser. No. 614,201, entitled "Removable Processing Cartridge for Electrostatographic Reproducing Apparatus," filed in the names of Werner F. Hoppner and James A. Landefeld. Reference is also made to copending application Ser. No. 614,216, entitled "Office Copier," filed in the names of Robert A. Clowe and Robert L. Gault, and Ser. No. 614,217, entitled "Office Copier Processing Cartridge" filed concurrently herewith in the names of Robert A. Clowe and Robert L. Gault.

BACKGROUND OF THE INVENTION

The present invention relates to electrostatographic reproducing apparatus and more particularly to a removable processing cartridge for use in such apparatus together with the means to maintain the position of the cartridge in its operative position.

In the electrostatographic reproducing apparatus commonly in use today, a photoconductive insulating member is typically charged to uniform potential and thereafter exposed to a light image of an original document to be reproduced. The exposure discharges the photoconductive insulating surface in exposed or background areas and creates an electrostatic latent image on the member which corresponds to the image areas contained within the usual document. Subsequently, the electrostatic latent image on the photoconductive insulating surface is made visible by developing the image with developing powder referred to in the art as toner. Most development systems employ a developer material which comprises both charged carrier particles and charged toner particles which triboelectrically adhere to the carrier particles. During development the toner particles are attracted from the carrier particles by the charge pattern of the image areas in the photoconductive insulating area to form a powder image on the photoconductive area. This image may subsequently be transferred to a support surface such as copy paper to which it may be permanently affixed by heating or by the application of pressure.

The electrostatographic reproducing apparatus commercially available today vary from the 9000 series of products available from Xerox Corporation to the small products in the small volume market designed for use by the casual user. Typical of the small volume products are the 3100 Family of Products available from Xerox Corporation. In each of these machines, the processor section of the reproducing apparatus is divided into at least two frame portions, an upper and lower frame portion which each contain various sections of the processing equipment. Typically the frame portions are hinged or pivoted about one end relative to one another. This machine configuration enables the user to readily attend to any particular machine malfunction such as a copy sheet being jammed in the paper path. As the uses of such automatic reproducing apparatus become more varied, and particularly as the desire for the casual user to use such low volume products manufacturers have designed smaller and more inexpensive products. To reach the casual user market, it is increasingly important to drive the simplicity and convenience of operation up as well as the cost of operation and replacement down. One way in which this may be accomplished is to place one or more electrostatographic processing stations in a replaceable processing cartridge which can be mounted in the frame of the reproducing apparatus. However the conventional hinges, counterbalances, locks, guide members, etc., all conventionally used for mounting such a cartridge, are relatively expensive to manufacture and assemble in a machine. It is accordingly a desire to provide a relatively low cost mount for such removable processing cartridge.

Furthermore in an attempt to produce a less expensive reproducing copier and one which has very little if any maintenance, it has been suggested to incorporate one or more processing stations of the apparatus in a disposable or removable cartridge. In this way the casual user can readily remove the cartridge when its operational life has been exhausted and insert a new cartridge. This also provides the advantage of being able to use less expensive functional features such as the photoreceptor than in a conventional copier.

PRIOR ART

The removable processing cartridges have taken many forms over the years. For example, in the Xerox 914, photoconductor drums have been made removable for years. Furthermore in the Xerox 9000 Family of Products, photoreceptor belts have also been removable. Other replaceable units have been discussed in the prior art, including developer housings, and toner dispensors. Perhaps the ultimate in sophistication of a removable cartridge is that described in U.S. Pat. No. 3,985,436 to (Tanaka et al) wherein a cartridge contains a photoreceptor, a developing device and a cleaning device, as well as a corotron, which cartridge may be releaseably inserted into the copying machine. Such cartridge is positioned in the machine by being inserted from one side thereof and having cooperative elements on the cartridge which are guided by guide members in the main frame of the machine. FIG. 3 of this patent illustrates what appears to be rigid handles for handling the cartridge.

A similar approach is used in the Canon PC 10/20, wherein a plastic molded cartridge containing a photoreceptor drum together with other elements including a developer housing and cleaner assembly are inserted from the side of the machine on essentially horizontal guide members to guide the cartridge into its final position in the machine. The Canon PC 10/20 has a rigid molded plastic handle at one side. This side entry requires at least two guide rails in the copier to locate the cartridge. In addition guide pin are required to accurately locate the cartridge.

Most of the automatic reproducing apparatus available in the prior art has used various separate stations for charging, exposing, developing, transferring and cleaning and discharging functions disposed about the photoconductive member. However the complexity and associated cost of the reproducing machine may be significantly reduced if the various separate functions are combined to form dual functions. Various attempts have been made to achieve this by combining units in an electrostatographic machine. For example, U.S. Pat. No. 3,637,306 to Cooper describes such a machine with a combined developing/cleaning unit which is operable to perform either function at the proper time during the copying sequence. U.S. Pat. No. 3,647,293 to Queener, describes a similar combined development/cleaning unit and U.S. Pat. No. 4,087,170 to Sawaoka et al describes a copying machine wherein the charge/transfer, exposure/discharge and developing/clean units are dual units to perform the indicated dual functions. During the first rotation of the drum charging, exposure and development are effected and in the second rotation of the drum transfer, discharge and cleaning are achieved. And finally in U.S. Pat. No. 4,372,669 to Fantuzzo et al., a two-cycle machine employing a photoconductive belt arranged in a recirculating path which is used with a combined charging/transfer unit and a combined developing/cleaning unit is provided.

SUMMARY OF THE INVENTION

The present invention is directed to a movable processing cartridge for electrostatographic apparatus as well as to the electrostatographic apparatus comprising same. In particular, the present invention is directed to a removable processing cartridge comprising a frame assembly containing at least one electrostatographic processing unit, means to mount the cartridge in a receiving mount in the reproducing apparatus and positioning means near the opposite end of the cartridge to maintain the cartridge in its operational position. The positioning means comprises a pair of elastomeric loops adapted to engage a frame member of the reproducing apparatus in a compression spring action to thereby ensure that the cartridge remains in its operational position. In addition the loops are of sufficient size and shape that they may be used as handles to manually extract the cartridge from the reproducing apparatus.

In a specific aspect of the present invention, the elastomeric loops are fastened to the upper portion or upper housing member of the cartridge frame assembly to provide a compression engagement with the bottom of the upper frame portion of a machine built in clam-shell fashion when it is pivoted to the closed position, thereby maintaining the cartridge in its operational position.

In a further aspect of the present invention, the reproducing apparatus comprises a lower and upper frame portion pivotable about one end in a clam-shell fashion and wherein the elastomeric loops are attached to one end of the upper frame portion.

In a further aspect of the present invention, the removable processing cartridge comprises a photoreceptor belt positioned and driven around a driven transport roll and a support roll together with a corona charging device an exposure slot for exposure of the charge photoreceptor belt and a drive gear mounted on one of said photoreceptor transport roll which engages with the main drive of the machine when the cartridge is in the operative position in the reproducing apparatus.

Accordingly it is an object of the present invention to provide a novel, removable processing cartridge for an electrostatographic reproducing apparatus.

It is a further object of the present invention to provide a compact and inexpensive means to maintain the position of the removable processing cartridge in the electrostatographic reproducing apparatus.

BRIEF DESCRIPTION OF THE DRAWINGS

In FIG. 5*a*, the cartridge has been inserted to the mount in the machine frame from the substantially upright position. In FIG. 5*b*, the cartridge is pivoted about the locating pivot pins on the machine frame with the mounting pins of the cartridge engaging the deflectable cantilever spring arms of the latch blocks on the main frame. FIG. 5*c* shows the cartridge locked in place in its operational position in the cartridge mount.

DESCRIPTION OF THE PREFERRED EMBODIMENT

The invention will now be described with reference to the preferred embodiment of the removable processing cartridge in electrostatographic reproducing apparatus employing same.

Figure 1:
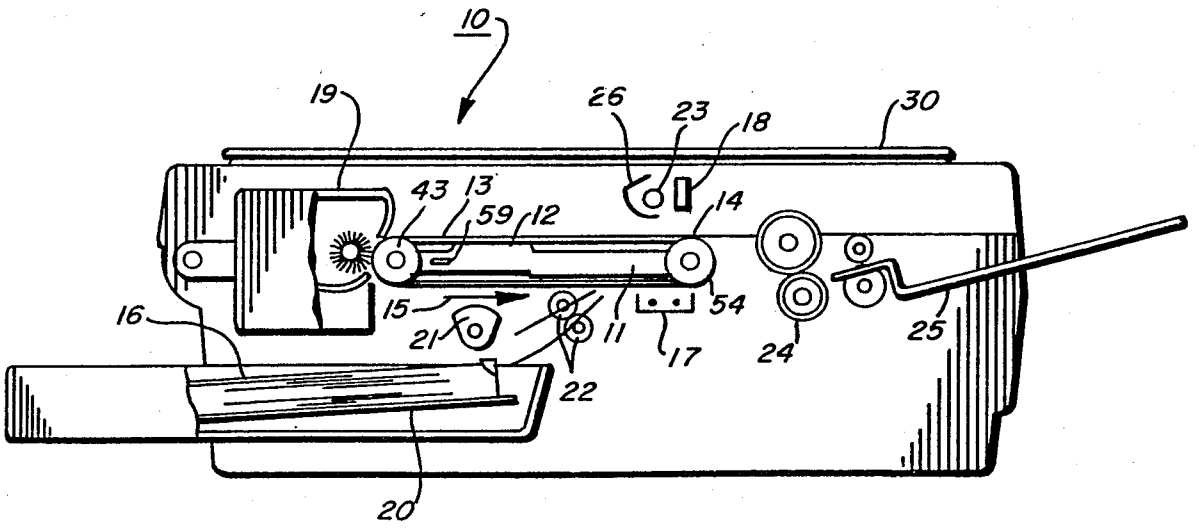
FIG. 1 is a schematic representation in cross-section of an automatic electrostatographic reproducing machine with the removable processing cartridge and mount therefore according to the present invention included therein.

Referring now to FIG. 1 there is shown by way of example an automatic xerographic machine 10 which includes the removable processing cartridge and cartridge mount of the present invention. The reproducing machine 10 depicted in FIG. 1 illustrates the various components utilized therein for producing copies from an original document. Although the apparatus of the present invention is particularly well adapted for use in an automatic xerographic reproducing machine 10, it should become evident from the following description that it is equally well suited for use in a wide variety of processing systems including other electrostatographic systems and it is not necessarily limited in application to the particular embodiment or embodiments shown herein.

The automatic reproducing machine 10 is adapted to operate in two-cycle fashion in that the photoreceptor belt is charged, exposed and the resulting electrostatic latent image developed on the first cycle of the belt while the developed toner image on the belt is transferrd to a copy sheet as the belt begins its second revolution through the processing stations. Thereafter in the second cycle of operation the belt is cleaned of residual toner by the developer station in preparation for producing the next copy. With this two-cycle geometry a combined charging/transfer unit and a combined developer/cleaning unit are used.

Figure 2:
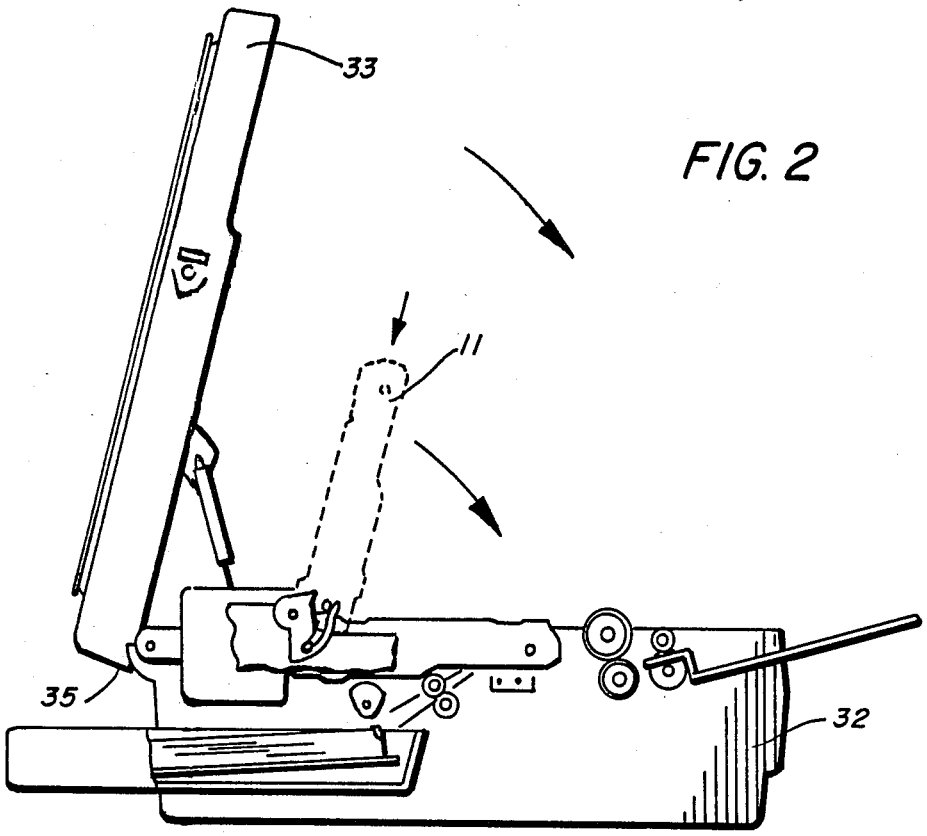
FIG. 2 is a schematic representation in cross-section of the automatic electrostatographic reproducing machine with the clam-shell opened and the removable processing cartridge in the upright loading position.

The reproducing machine 10, illustrated in FIGS. 1 and 2 employs a removable processing cartridge 11, image recording belt like member 12, the outer periphery of which is coated with a suitable photoconductive material 13. The belt 12 is suitably mounted for revolution within the cartridge about driven transport roll 43 and idler roll 54 and travels in the direction indicted by arrow 15 to bring the image-bearing surface 13 thereon past a plurality of xerographic processing stations. Suitable drive means (not shown) are provided to power and coordinate the motion of the various cooperating machine components whereby a faithful reproduction of the original input scene information is recorded upon a sheet of final support material 16 such as paper or the like.

Initially, the belt 12 moves the photoconductive surface 13 through a charging/transfer station 17 where in the first cycle, the belt is charged with an electrostatic charge uniformly placed over the photoconductive surface 13 in known manner preparatory to imaging. Thereafter, the belt 12 is driven to exposure station 14 where the charged photoconductive surface 13 is exposed to a light image of the original input scene information whereby the charge is selectively dissipated in the light exposed regions to record the original input scene in the form of an electrostatic latent image. The exposure station preferably comprises a bundle of image transmitting fiber lenses 18, produced under the tradename of SELFOC by Nippon Sheet Glass Company, Limited, together with an illuminating lamp 23 and reflector 26. After exposure the belt 12 transports the electrostatic latent image recorded on the photoconductive surface 13 to development/cleaning station 19 wherein a developer is applied to the photoconductive surface of the drum 12 rendering the latent image visible. Typically a suitable development station could include a magnetic brush development system utilizing a magnitizable developer mix having coarse ferromagnetic carrier granules and toner colorant particles.

Sheets 16 of the final support material are supported in a stack arrangement of an elevating stack support tray 20. With the stack at its elevated position a sheet separator segmented feed roll 21 feeds individual sheets therefrom to the registration pinch rolls 22. The sheet is then forwarded to the charging/transfer station 17 in proper registration with the image on the belt and the developed image on the photoconductive surface 13 is brought into contact with the sheet 16 of final support material within the charging/transfer station 17 and the toner image is transferred from the photoconductive surface 13 to the contacting side of the final support sheet 16. Following transfer of the image the final support material which may be paper, plastic, etc., as desired is separated from the belt by the beam strength of the support material 16 and, the sheet with the toner image thereon is advanced to a suitable fuser such as roll fuser 24 which fixes the transferred powder image thereto. After the fusing process the sheet 16 is advanced to a suitable output device such as tray 25.

Although a preponderance of toner powder is transferred to the final support material 16, invariably some residual toner remains on the photoconductive surface 13 after the transfer of the toner powder image of the final support material. The residual toner particles remaining on the photoconductive surface 13 after the transfer operation are removed from the belt 12 as it moves in its second cycle through the developing/cleaning station 19 where the toner particles may be mechanically cleaned from the photoconductive surface 13 by the same magnetic brush as used in developing the electrostatic latent image. To assist in cleaning the belt 12 of the residual toner, a toner particle disturber which may comprise a bar magnet 59 under the belt is provided to gently disturb the location of the individual toner particles thereby facilitating subsequent cleaning.

Normally, when the copier is operated in a conventional mode, the original document to be reproduced is placed image side down upon a horizontal transparent viewing platen 30 which transports the original past an optical arrangement here illustrated as Selfoc lens 18. The speed of the moving platen and the speed of the photoconductive belt are synchronized to provide a faithful reproduction of the original document.

It is believed that the foregoing general description is sufficient for the purposes of the present application to illustrate the general operation of an automatic xerographic copier 10 which can embody the apparatus in accordance with the present invention.

FIG. 2 illustrates the electrostatographic reproducing machine wherein the upper machine frame 33 has been pivoted about machine pivot 35 away from lower machine frame 32 to expose the upper portion of the apparatus. The removable processing cartridge is illustrated in solid line in its operational position and also illustrated in dashed line at its initial insert position. The removable processing cartridge is mounted as will be discussed hereinafter by inserting it such that the mounting hinge slots on the cartridge engage the locating pivot points on the lower frame of the machine while the mounting pins on the cartridge engage the latch blocks on the lower frame of the machine, thereby enabling the cartridge to be pivoted clockwise from its initial insert position to the operational position as indicated in FIG. 2.

Figure 3:
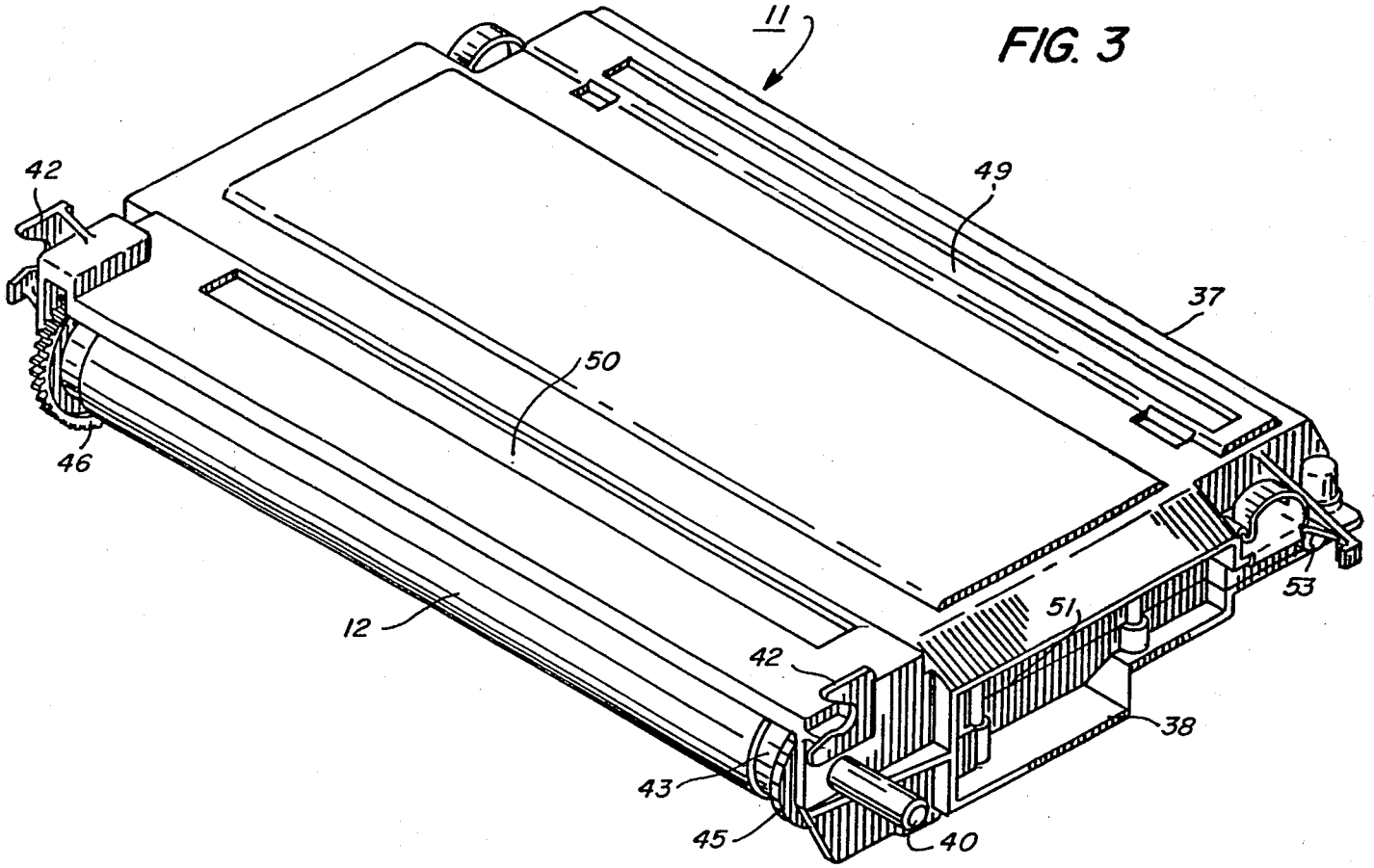
FIG. 3 is an isometric view showing the removable processing cartridge according to the present invention.
Figure 4:
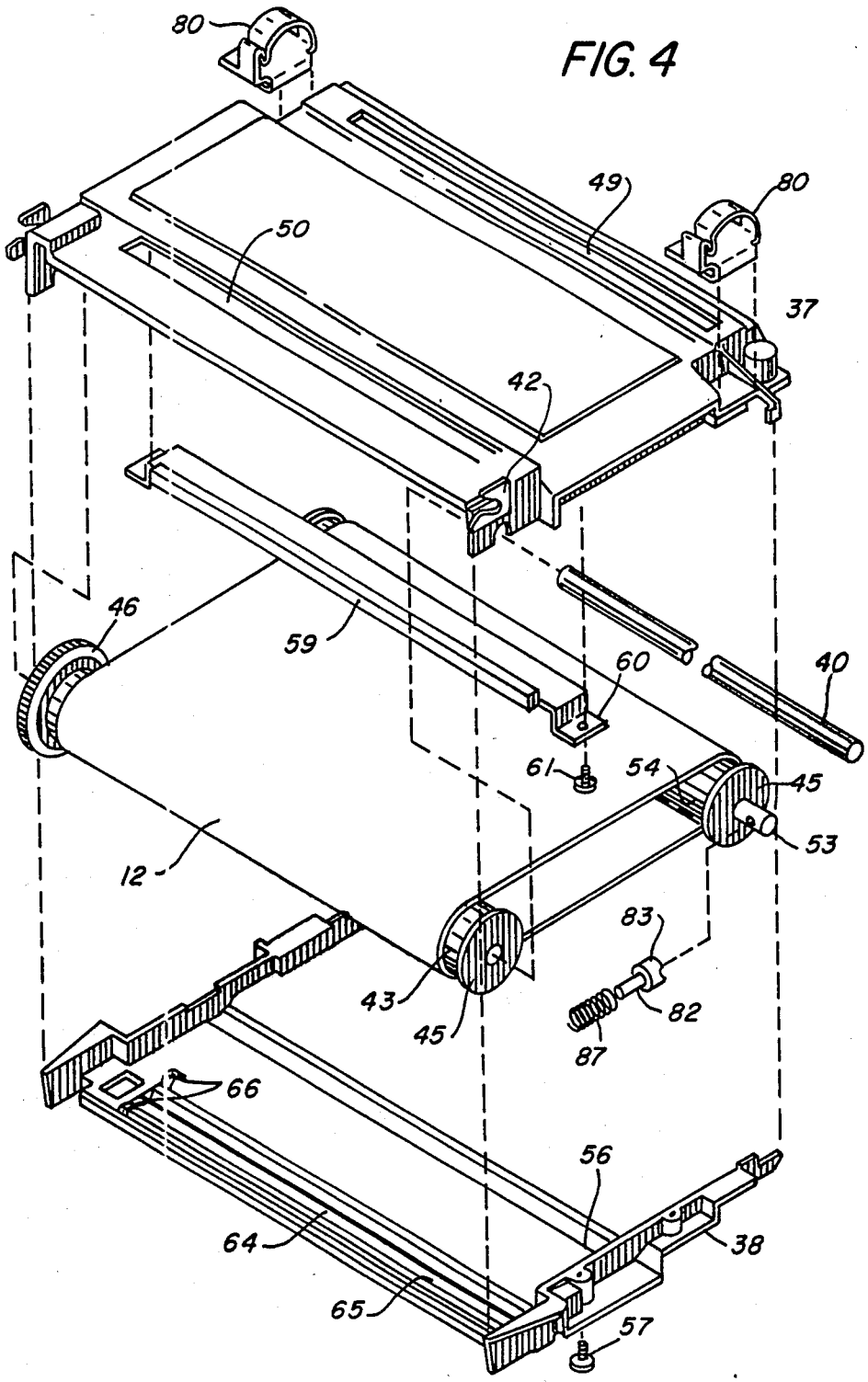
FIG. 4 is an exploded view of the removable processing cartridge according to the present invention.

The removable processing cartridge is illustrated in greater detail in isometric FIG. 3 taken together with exploded FIG. 4. The cartridge assembly 11 comprises an upper cartridge housing 37 and a lower cartridge housing 38, which are fastened together through housing fasteners 56 by a suitable means such as screws 57. The mounting arrangement for the cartridge comprises mounting pins 40 on each side of one end of the cartridge assembly here illustrated as the stationary drive shaft for the belt transport roll 43. Both ends of the belt transport roll have end caps 45 positioned thereon with one end being connected through drive gear 46 to the main machine drive to provide positive drive to the belt. Positioned adjacent to the mounting pins 40 on both sides of the cartridge are mounting hinge slots 42, the operation of which will be described in greater detail hereinafter. At the other end of the cartridge assembly in a idler roll shaft 53 about which the idler roll 54 is mounted, once again with end caps 45 at each end thereof. The photoreceptor belt 12 is transported around transport roll 43 and idler roll 54 through the various processing stations in the two-cycle reproducing apparatus. In addition to the removable processing cartridge being equipped with the photoreceptor belt it may also have additional electrostatographic processing units and functions contained therein. Exposure slot 49 permits exposure of the photoreceptor belt from the optical system of the reproducing apparatus. Furthermore erase slot 50 permits the exposure of the photoreceptor during the second cycle of imaging and just prior to cleaning of residual toner image by an erase lamp. In addition, the upper cartridge housing 37 contains a slot for an image disturber apparatus which may comprise magnet 59 held in magnetic holder 60 fashioned to the lower cartridge housing by means of screws 61. In addition and with particular reference to FIG. 4, the removable processing cartridge may contain a corotron such as pre-charge corotron 64 contained within corotron shield 65. The processing cartridge also contains two spring ground contacts 66 for electrically grounding the photoreceptor belt.

With further reference to FIGS. 5*a*, 5*b*, 5*c*, and FIG. 6, the mounting arrangement contained within the cartridge itself as well as the mounting arrangement contained within the lower machine frame 32 will be described in greater detail. While the mounting arrangement will be generally described with reference to one side of the main frame and cartridge, it will be understood that an identical mount is positioned on the opposite side of the main frame and cartridge. The removable processing cartridge contains at one end thereof and adjacent to each other, mounting hinge slots 42 on each side of the cartridge which when the cartridge is inserted into the lower machine frame, engage two machine frame locating pins 68 fixedly attached to lower machine frame 32. The cartridge also contains mounting pins 40 at each side thereof, here illustrated as the shaft of transport roll 43 which engage latch blocks 70 on both sides of the lower machine frame 32 which are fixedly attached to the lower machine frame by latch block anchors 72. The latch block is provided with a slot 74 through which the mounting pins 40 on the cartridge may be inserted. In addition, the latch block is designed so as to have a deflectable cantilever spring arm 76 in interference engagement with the mounting pins 40, such that as the mounting pins are forced down into the slot 74 the spring arm 76 is deflected slightly clockwise thereby providing a counterbalancing action to the insertion of the processing cartridge. At the end of the slot 74 there is a detent or circular lock portion which fully accommodates the cartridge mounting pins when they reach that point, permitting the cantilever spring arm to return to its undeflected position thereby locking the cartridge in place. On the other side of the spring arm is a guide surface 75 which together with the spring arm guides the mounting pins of the photoreceptor cartridge into place. Also attached and as may be more clearly illustrated in FIG. 6, the spring arm 76 has a frame stop member 78 to laterally maintain the in position against the machine lower frame members 32.

Figure 5A:
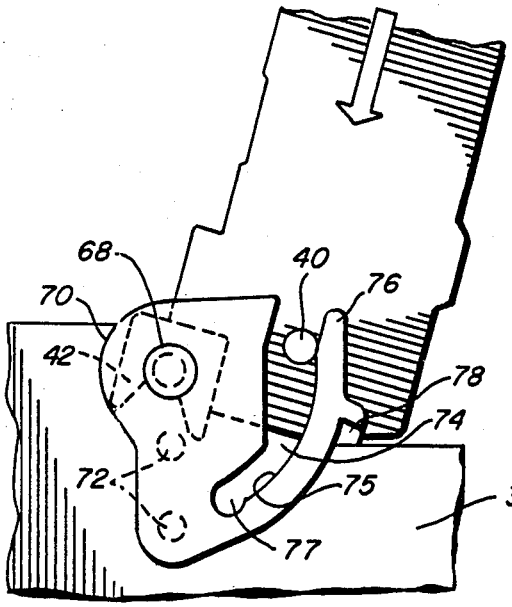
FIGS. 5*a*, 5*b*, 5*c* are each side views showing the removable processing cartridge mount used according to the present invention.
Figure 5B:
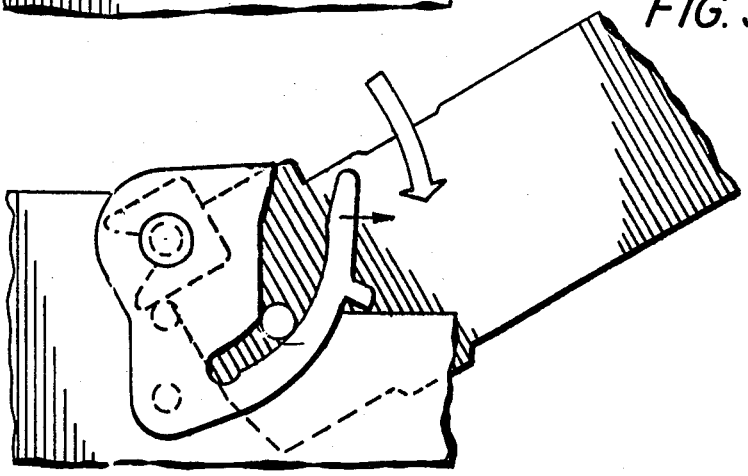
Figure 5C:
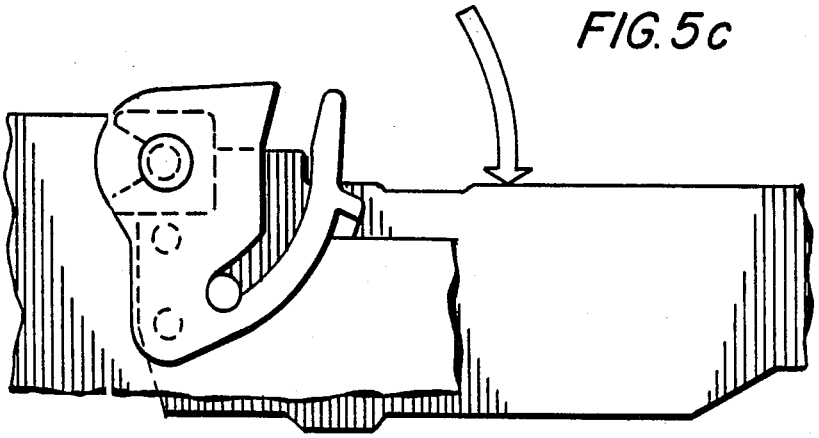
Figure 6:
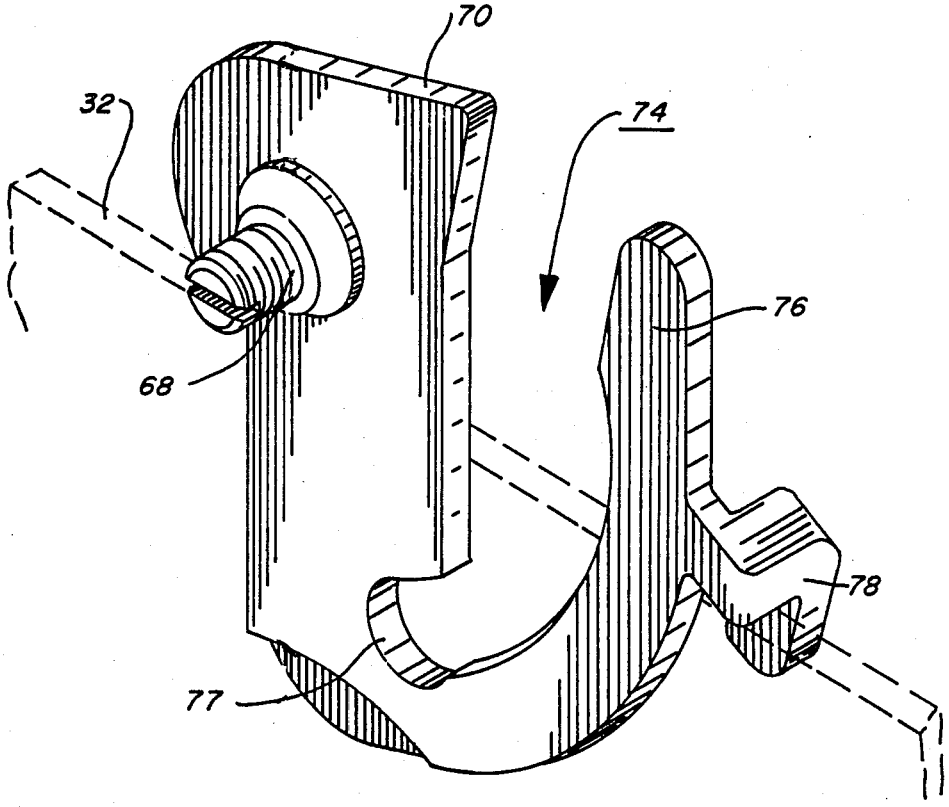
FIG. 6 is an enlarged isometric view of the latch block positioned on the machine frame for inserting the cartridge therein.

With continued reference to FIG. 5*a*, 5*b*, and 5*c* and with particular reference to the directional arrows for both the cartridge as a whole as well as for the movement of the cartridge mounting pin 40 in the slot 74 of the latch block 70, together with this movement in a clockwise direction, the insertion of the cartridge will be described in greater detail. For the cartridge to be inserted in its operational position, the upper machine frame 33 must be rotated in a counterclockwise direction about pivot point 35 thereby creating an open space between upper machine frame 33 and lower machine frame 32. The cartridge is manually positioned in an almost vertical orientation such that the mounting hinge slots 42 on each side of the cartridge are placed on the locating pivot pins 42 on each side of the lower machine frame. At this time the mounting pins 40 on the cartridge engage the uppermost position of the deflectable cantilever spring arm 76 of the latch block as seen in FIG. 5*a*. Once in this position the cartridge is manually rotated in a clockwise direction to drive the cartridge mounting pins into interference with the upper portion of the deflectable cantilever spring. Te cartridge continues to be rotated and forced down meeting the resistance of the spring which prevents the cartridge from dropping into the housing thereby causing potential damage to the cartridge or the machine. As the cartridge is rotated in a clockwise direction illustrated further in FIG. 5*b*, the cantilever spring arm 76 is deflected also in a clockwise position as the mounting pins on the cartridge traverse the slot in the latch block. Finally the mounting pins 40 are forced over the final interference of the spring arm into the circular detent or lock portion 77 and the cantilevered spring arm is free to snap back into its original position thereby producing a torque about the pivot pins which is the force which holds the entire cartridge assembly into its exact location which insures drive gear 46 is perfectly in mesh with the main drive gear mounted in machine frame. In other words the cartridge pivots into place about the fixed pivot pins about which it is fixedly positioned through interaction with the mounting hinge slots. When the mounting pins 40 on the cartridge are forced over the final interference of the spring arm, the spring force creates the torque which tends to drive the opposite (non-mounting) end down into position. The guide surface 75 maintains the cartridge in its upper position when initially inserted into the receiving mount in the lower machine frame and limits the motion of the cartridge so that it does not back against the adjacent developer housing. To facilitate the above described functions of the deflectable cantilever spring, it is desirable that the latch blocks 70 be made from a suitable plastic material which can be slightly deflected.

Accordingly the latch block provides a number of functions. The slot with the curved outer deflectable spring acts initially as a limiting stop, then as a cantilever spring counterbalance and finally as a locating member for the mounting pin on the cartridge. Furthermore the stationary inner guide surface prevents the cartridge upon insertion from falling or rotating back on the developer housing. In this connection it should be noted that in the machine configuration depicted the cartridge is mounted such that the end of the photoreceptor belt around the transport roll is in functional cooperation with the developer assembly in the main frame. The developer assembly may be biased by a spring, for example, into engagement with the mounting end of the cartridge to form this functional cooperation.

Figure 7:
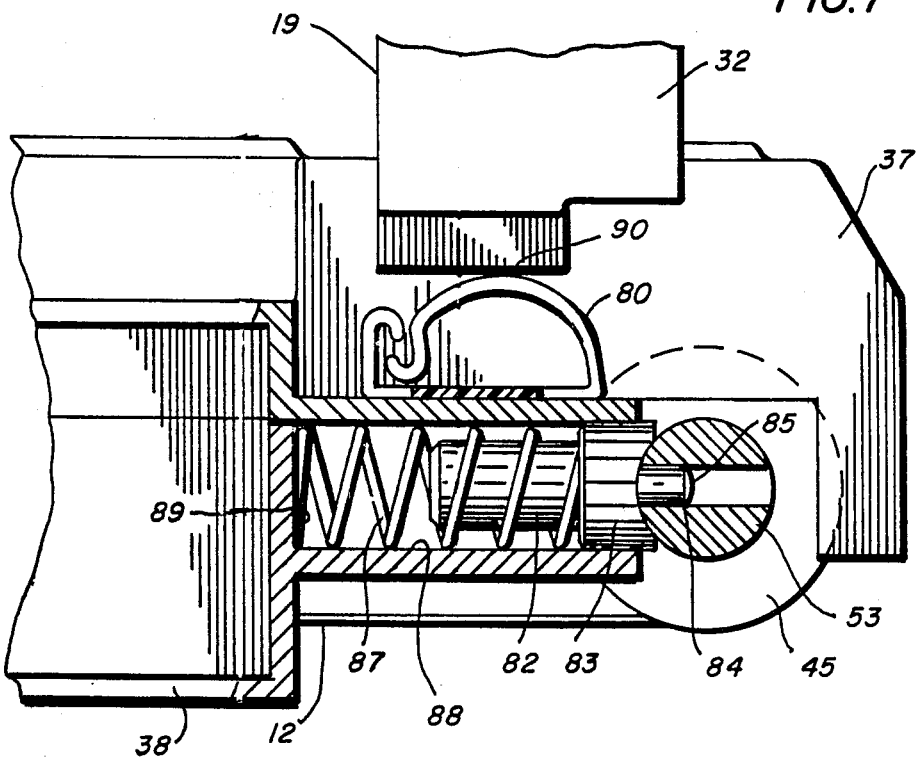
FIG. 7 is a side view of the belt tensioning device and lifting handles.

With continued reference to FIGS. 3 and 4 and further reference to FIG. 7, an additional feature of the present invention resides in the use of a pair of elastomeric U-shaped loops or handles 80 fastened to each side of the processing cartridge at the end of the cartridge away from the mounting end. These elastomeric handles function in two respects; as a handle in which to lift the removable processig cartridge from its operating position and extract or withdraw it from the lower machine frame. Accordingly the loops should be of sufficient size that a finger may be inserted therein to lift the end of the cartridge from its locked position. The loops also function when the cartridge is in the operational position and when the upper machine frame 33 has been rotated clockwise into its locked functional position as a spring to urge the cartridge to remain in a fixed plane thereby ensuring that the image plane is in the same position for all imaging functions. This is enabled by the elastomeric spring loops contacting the bottom of the optics base pan 90 which is in the upper machine frame 32, so that the cartridge is seated in the operational position at all times by virtue of the compression spring action of the loops. The spring force provided should be sufficient to insure that the non-mounting end of the cassette is properly seated in its operational position with the top run of the belt in the focal plane. Any suitable elastomeric material may be used as the cartridge positioning loop and handle. Typical materials will be those commonly available materials having acceptable spring characteristics when deflected and include among others commercially available polypropylenes.

Figure 9:
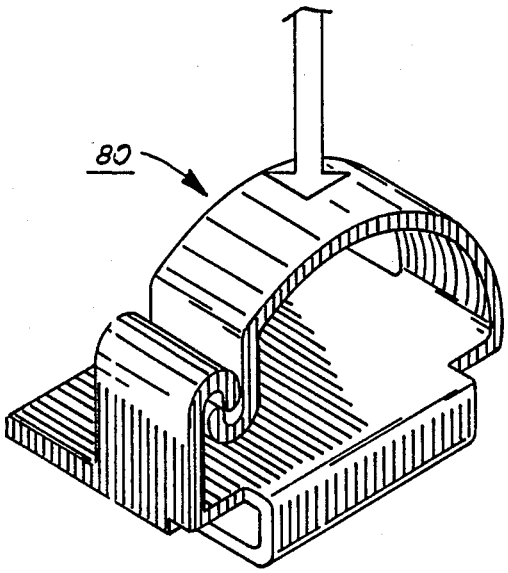
FIG. 9 is an isometric view of a preferred embodiment of the lifting or spring handles on the cassette illustrating the spring portion to be slightly depressed by a force.

FIG. 9 illustrates a preferred embodiment of the spring lifting loops which may be molded from polypropylene forming a single piece spring end lifting loop. This general configuration facilitates molding as well as the design of the appropriate spring force in the piece. In the figure the spring element is slightly depressed by a force without which the spring element would be biased into engagment with the illustrated locking member of the single piece.

Figure 8:
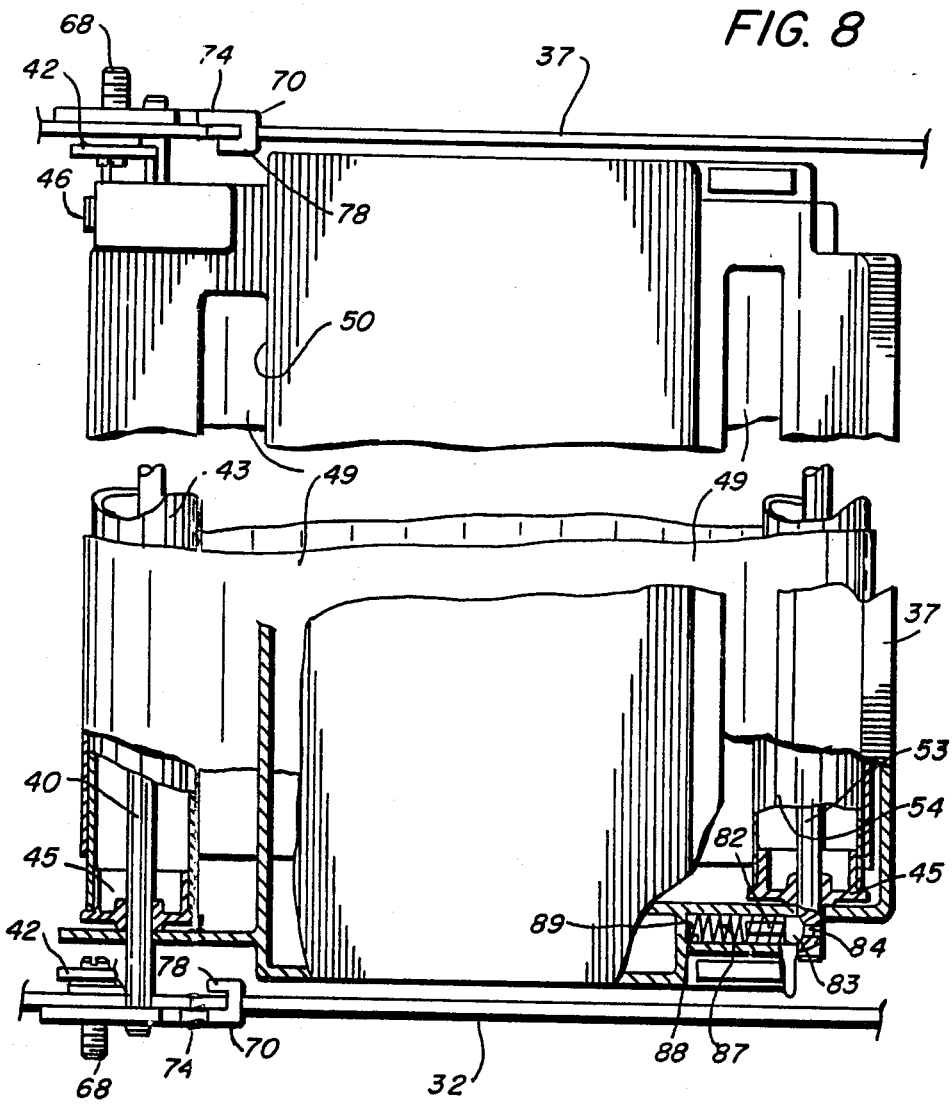
FIG. 8 is a top view, partly cut away, of the machine and cartridge mounts with the cartridge in position.

To further maintain the photoreceptor belt in a fixed focal plane, tension is provided in the belt by means illustrated with reference to FIG. 4 and additional reference to FIGS. 7 and 8. The belt is tensioned so that the image plane on the top run of the belt, when it is exposed to the document being copied, is uniform across the entire slot. If it is not uniform across the entire slot, at least a portion of the image may be out of focus and there will be a defect in the resultant copy quality. Similarly if the belts is not properly tensioned, difficulty with respect to erratic transfer of the toner image on the photoreceptor belt to the receiving copy sheet may be experienced. To achieve this, at both ends of the photoreceptor idler roll 54 a tensioning arrangement is provided. This tensioning arrangement comprises a guide pin 82 which is spring biased by spring means 87 to drive both ends of the idler roll shaft away from the photoreceptor driven roll. The guide pin 82, one of which has a pilot pin 84 which fits in hole 85 of idler roll shaft, the other end of which resides in slot 88 in the upper housing of the cartridge. The spring 87 which is around a portion of the guide pin 82 is biased between stop 89 in the upper cartridge housing and the collar 83 on the guide pin 82 to provide suitable tensioning on both sides of the photoreceptor belt and therefore a uniform imaging plane across the entire exposure slot, and also, a uniform plane for elastrostatic transfer of the toner image to the receiving copy sheet.

Thus it may be readily appreciated by reference to the foregoing description when taken with the drawings that the present invention provides a relatively simple, inexpensive, removable processing cartridge for an electrostatographic reproducing apparatus. The simple, inexpensive positioning means can be used to ensure both maintaining the position of the cartridge in its operative position and facilitating the removal of the cartridge from the copier when desired. In addition the cartridge positioning member is relatively inexpensive and requires a minimum of assembly time.

The disclosures of the patents referred to herein are hereby specifically and totally incorporated herein by reference.

While the invention has been described with reference to specific embodiments it will be apparent to those skilled in the art that many alternatives, modifications and variations may be made. For example, while the removable cartridge has been described as including a photoreceptor belt, a corotron, an image disturber, two exposure slots, one or more of these features could be omitted as well as additional features being added to the cartridge. Accordingly it is intended to embrace all such alternatives and modifications as may fall within the spirit and scope of the appended claims.

What is claimed is:

1. A removable processing cartridge for an electrostatographic reproducing apparatus comprising a cartridge frame assembly containing at least one electrostatographic processing unit, means to mount said cartridge about end thereof to a receiving mount in said reproducing apparatus and positioning means near the opposite end of said cartridge, said positioning means comprising elastomeric loops adapted to engage a frame member of said reproducing apparatus in a compression spring action to thereby maintain the cartridge in its operational position, said loops being of sufficient size and shape that they may be used as handles to manually extract the cartridge from said reproducing apparatus.

2. The cartridge of claim 1, wherein said cartridge frame assembly comprises an upper housing member and a lower housing member and means to fasten said upper and lower housing members together.

3. The cartridge of claim 2, further including a driven transport roll, an idler support roll and wherein said at least one processing unit is a photoreceptor belt mounted and driven about said transport and support rolls.

4. The cartridge of claim 3, further including a corona charging device, an exposure slot for exposing a charged photoreceptor belt and a drive gear mounted on one end of said photoreceptor transport roll which engages with the main drive of the machine when the cartridge is in said reproducing apparatus in its operative position.

5. The cartridge of claim 4 further including an erase slot in the upper housing member and a magnetic image disturber bar.

6. The cartridge of claim 1, wherein said mounting means on said cartridge comprises a pair of mounting hinge slots, one on each side of the mounting end of said cartridge which are positioned for cooperative engagement with a pair of locating pivot pins located one on each side of the frame of the reproducing apparatus about which said cartridge may be pivoted and, a pair of mounting pins one on each side of one end of said cartridge adjacent said mounting hinge slots which pins are positioned for cooperative engagement with a pair of cartridge latch blocks located one on each side of the frame of the reproducing apparatus.

7. The cartridge of claim 6, wherein said pair of mounting pins comprises the mounting shaft for a photoreceptor belt support roll.

8. The cartridge of claim 7, wherein said mounting shaft is stationary and said support roll is a driven transport for a photoreceptor belt.

9. The cartridge of claim 8, further including an idler support roll and wherein said at least one processing unit is a photoreceptor belt.

10. An electrostatographic reproducing apparatus comprising a main frame and a removable processing cartridge comprising a frame assembly containing at least one electrostatographic processing unit, means to mount sasid cartridge to a receiving mount in said reproducing apparatus about one end thereof, said cartridge frame assembly including positioning means near the opposite end of said cartridge said positioning means, comprising elastomeric loops adapted to engage a frame member of said reproducing apparatus in a compression spring action to thereby maintain the cartridge in its operational position, said loops being of sufficient size and shape that they may be used as handles to manually extract the cartridge from said reproducing apparatus.

11. The apparatus of claim 10, wherein said cartridge frame assembly comprises an upper housing member and a lower housing member and wherein said main frame comprises a lower frame portion and an upper frame portion pivotal about one end in clam-shell fashion and wherein said cartridge mounting means are attached to said lower frame portion and said cartridge can be inserted from the top into said cartridge mounting means only when said upper frame portion is pivoted to an open position, and wherein said elastomeric loops are fastened to the upper housing member to provide a compression engagement with the bottom of the upper frame portion when it is pivoted to the closed position, thereby maintaining the cartridge in its operational position.

12. The apparatus of claim 11, further including a driven transport roll, an idler support roll and wherein said at least one processing unit is a photoreceptor belt mounted and driven about said transport and support rolls.

13. The apparatus of claim 12, further including a corona charging device, an exposure slot for exposing a charged photoreceptor belt and a drive gear mounted on one end of said photoreceptor transport roll which engages with the main drive of the machine when the cartridge is in said reproducing apparatus in its operative position.

14. The apparatus of claim 13, further including an erase slot in the upper housing members and a magnetic image disturber bar.

15. The apparatus of claim 10, wherein said mounting means attached to said main frame comprises a pair of locating pivot pins, one one each side of the frame and a pair of cartridge latch blocks adjacent said locating pivot pins one on each side of the frame; and said cartridge mounting means attached to said cartridge comprises a pair of mounting hinge slots one on each side of one end of said cartridge which are positioned for cooperative engagement with the pair of locating pivot pins on the main frame and, a pair of mounting pins, one on each side of one end of said cartridge adjacent said mounting hinge slots which pins are positioned for cooperative engagement with the pair of cartridge latch blocks on the main frame of the reproducing apparatus.

16. The apparatus of claim 15, wherein said cartridge latch blocks have arcuate slots therein defining a stationary inner guide surface and a curved outer deflectable cantilever spring arm, said slots terminating at its lower portion in a cartridge lock for said cartridge mounting pins and wherein when said cartridge is initially inserted in said mount with said cartridge mounting hinge slot resting on said main frame locating pivot pins said cartridge mounting pins engage the upper end of said curved outer deflectable cantilever spring arm and as said cartridge is pivoted about said locating pivot pins said spring arm provides an interference for said cartridge mounting pins and is deflected thereby providing a counterbalance to said cartridge as it is lowered in position.

17. The apparatus of claim 16, wherein said cartridge lock comprises a circular portion which accommodates the cartridge mounting pins when in position permitting said cantilever spring arm to return to its undeflected position when said mounting pins are in said circular position thereby locking said cartridge in position.

18. The apparatus of claim 17, wherein said spring arm has a stop member to laterally maintain the cartridge in position.

* * * * *